US006980759B2

(12) United States Patent
Kanno et al.

(10) Patent No.: US 6,980,759 B2
(45) Date of Patent: Dec. 27, 2005

(54) PROCESS CARTRIDGE AND ELECTROPHOTOGRAPHIC IMAGE FORMING APPARATUS

(75) Inventors: Kazuhiko Kanno, Kanagawa (JP); Kazuo Chadani, Shizuoka (JP); Tomonori Mori, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/835,116

(22) Filed: Apr. 30, 2004

(65) Prior Publication Data

US 2005/0069342 A1 Mar. 31, 2005

(30) Foreign Application Priority Data

Sep. 25, 2003 (JP) ..... 2003-334197

(51) Int. Cl.[7] ..... G03G 21/16
(52) U.S. Cl. ..... 399/111; 399/113
(58) Field of Search ..... 399/111, 113, 119, 399/168, 174, 175, 176, 107

(56) References Cited

U.S. PATENT DOCUMENTS

| | | | | |
|---|---|---|---|---|
| 4,851,960 | A | 7/1989 | Nakamura et al. | 361/225 |
| 5,465,136 | A | 11/1995 | Watanabe | 355/210 |
| 5,729,796 | A | 3/1998 | Miura et al. | 399/114 |
| 5,815,644 | A | 9/1998 | Nishiuwatoko et al. | 399/113 |
| 5,870,655 | A | 2/1999 | Nishiuwatoko et al. | 399/111 |
| 5,893,006 | A | 4/1999 | Kanno et al. | 399/13 |
| 5,926,666 | A | 7/1999 | Miura et al. | 399/25 |
| 5,937,240 | A | 8/1999 | Kanno et al. | 399/111 |
| 5,950,049 | A | 9/1999 | Yokomori et al. | 399/119 |
| 6,070,029 | A | 5/2000 | Nishiuwatoko et al. | 399/111 |
| 6,173,140 | B1 | 1/2001 | Suzuki et al. | 399/113 |
| 6,173,145 | B1 | 1/2001 | Chadani et al. | 399/265 |
| 6,266,503 | B1 | 7/2001 | Murayama et al. | 399/117 |
| 6,345,164 | B1 | 2/2002 | Yokomori et al. | 399/119 |
| 6,381,430 | B1 | 4/2002 | Yokomori et al. | 399/119 |
| 6,681,088 | B2 * | 1/2004 | Kanno et al. | 399/111 |
| 6,801,733 | B2 * | 10/2004 | Daniels et al. | 399/109 |
| 2002/0061205 | A1 | 5/2002 | Tsuda et al. | 399/111 |
| 2003/0215261 | A1 | 11/2003 | Karakama et al. | 399/111 |

FOREIGN PATENT DOCUMENTS

| | | |
|---|---|---|
| JP | 63-149669 | 6/1988 |
| JP | 4-043378 | 2/1992 |
| JP | 5-188667 | 7/1993 |
| JP | 2900530 | 3/1999 |
| JP | 2000-181328 | 6/2000 |
| JP | 2001-337511 | 12/2001 |
| JP | 2001-337511 A | 12/2001 |
| JP | 2002-6722 | 1/2002 |
| JP | 2002-6722 A | 1/2002 |

* cited by examiner

*Primary Examiner*—Hoang Ngo
(74) *Attorney, Agent, or Firm*—Fitzpatrick, Cella, Harper & Scinto

(57) ABSTRACT

A process cartridge and an electrophotographic image forming apparatus in which both a developing member and a charging member are separable from an electrophotographic photosensitive member by changing the swinging attitudes of a photosensitive member unit and a developing unit, thereby making it possible to obtain, with a simple construction, a stable image free from unevenness or transversal streaks.

17 Claims, 11 Drawing Sheets

PROCESS CARTRIDGE AND ELECTROPHOTOGRAPHIC IMAGE FORMING APPARATUS

BACKGROUND OF THE INVENTION

1. Field of the Invention

The present invention relates to a process cartridge and an electrophotographic image forming apparatus using the same.

2. Related Background Art

Conventionally, in image forming apparatuses using an electrophotographic image forming process, there has been adopted a process cartridge system, in which an electrophotographic photosensitive member and a process means acting on the electrophotographic photosensitive member are integrated into a cartridge that is detachably mountable to a main body of an image forming apparatus. In the process cartridge system, maintenance on the apparatus can be conducted by a user himself without relying on a service man, thus achieving a substantial improvement in terms of operability. Thus, the process cartridge system is widely adopted in electrophotographic image forming apparatuses.

Among the electrophotographic image forming apparatuses are in-line type color electrophotographic image forming apparatuses in which a plurality of process cartridges are arranged in a row. There is available a contact development system, in which a developing roller as a developing member constituting a developing means of each of such cartridges is held in contact, for example, with a drum-shaped electrophotographic photosensitive member, that is, a photosensitive drum, to effect development. To maintain a predetermined contact pressure between the developing roller and the photosensitive drum during image formation, the developing roller is urged against the photosensitive drum.

In case of this system, if the image forming apparatus is left unused for a long period of time with the process cartridges attached to the main body of the image forming apparatus, there is a fear of an elastic layer of each developing roller undergoing permanent deformation, thereby generating image unevenness during development.

As a construction for solving this problem, there have been proposed, in JP 2900530 B and JP 2001-337511 A, a process cartridge equipped with a mechanism for separating the photosensitive drum and the developing roller from each other when image forming operation is not being conducted, and an image forming apparatus using such a process cartridge.

Apart from this, as a charging means for charging the surface of the photosensitive drum of a process cartridge for forming images by electrophotography, a corona charger has been widely put into practical use. Corona charging is effective as a method of charging a surface to be charged uniformly to a predetermined electric potential. However, it requires a high voltage power source, and involves problems such as ozone generation due to corona discharge.

As a solution to this problem, there has been devised a contact charger for performing a charging process while keeping a charging roller as a charging member in contact with the surface of the photosensitive drum.

Like the developing roller, if left unused for a long period of time, this contact charger may involve permanent deformation of the elastic layer of the charging roller, resulting in generation of transversal streaks in the image at intervals corresponding to the charging roller cycle. Further, due to vibration, surfaces of the charging roller and the photosensitive drum may rub each other, which leads to generation of a local difference in potential, i.e., so-called rubbing memory in the surface of the photosensitive drum. This may also lead to generation of transversal streaks in the image at intervals corresponding to the charging roller cycle.

As means for avoiding this problem, JP 5-188667 A proposes a method according to which a member for separating the charging roller and the photosensitive drum from each other is held between them during shipment of the process cartridge, the member being removed by the user before using the cartridge. Further, U.S. Pat. No. 5,465,136 and JP 2000-181328 A propose a process cartridge or the like equipped with a mechanism which brings the charging roller, which has been kept separate from the associated photosensitive roller, into contact with it when the process cartridge is attached to the main body of the image forming apparatus.

Further, JP 2002-6722 A proposes a process cartridge in which the developing roller and the charging roller, held in the same unit, are kept apart from each other by means of a stopper or a spacing member until the process cartridge is put to use, and an image forming apparatus using such a process cartridge.

SUMMARY OF THE INVENTION

The present invention has been made with a view toward solving the above problems in the conventional art.

In accordance with the present invention, there is no need to separately provide the image forming apparatus main body with a mechanism for separating the charging member, thereby making it possible to provide an inexpensive and space-saving process cartridge.

Further, according to the present invention, solely by changing the swinging attitude of a first unit having an image bearing member and a charging member and a second unit having a developing member, it is possible to separate the developing member and the charging member from the image bearing member, whereby it is possible to obtain, with a simple construction, a stable image exhibiting no unevenness or transversal streaks.

DESCRIPTION OF THE PREFERRED EMBODIMENTS

In the following, a process cartridge and a color electrophotographic image forming apparatus according to the present invention will be described in more detail with reference to the drawings.

It is to be noted that, in the present invention, a process cartridge refers to what is obtained by integrating at least one of a charging means, a developing means, and a cleaning means with an electrophotographic photosensitive member into a cartridge, which is detachably mountable to the main body of an electrophotographic image forming apparatus.

Embodiment 1

Figure 1:
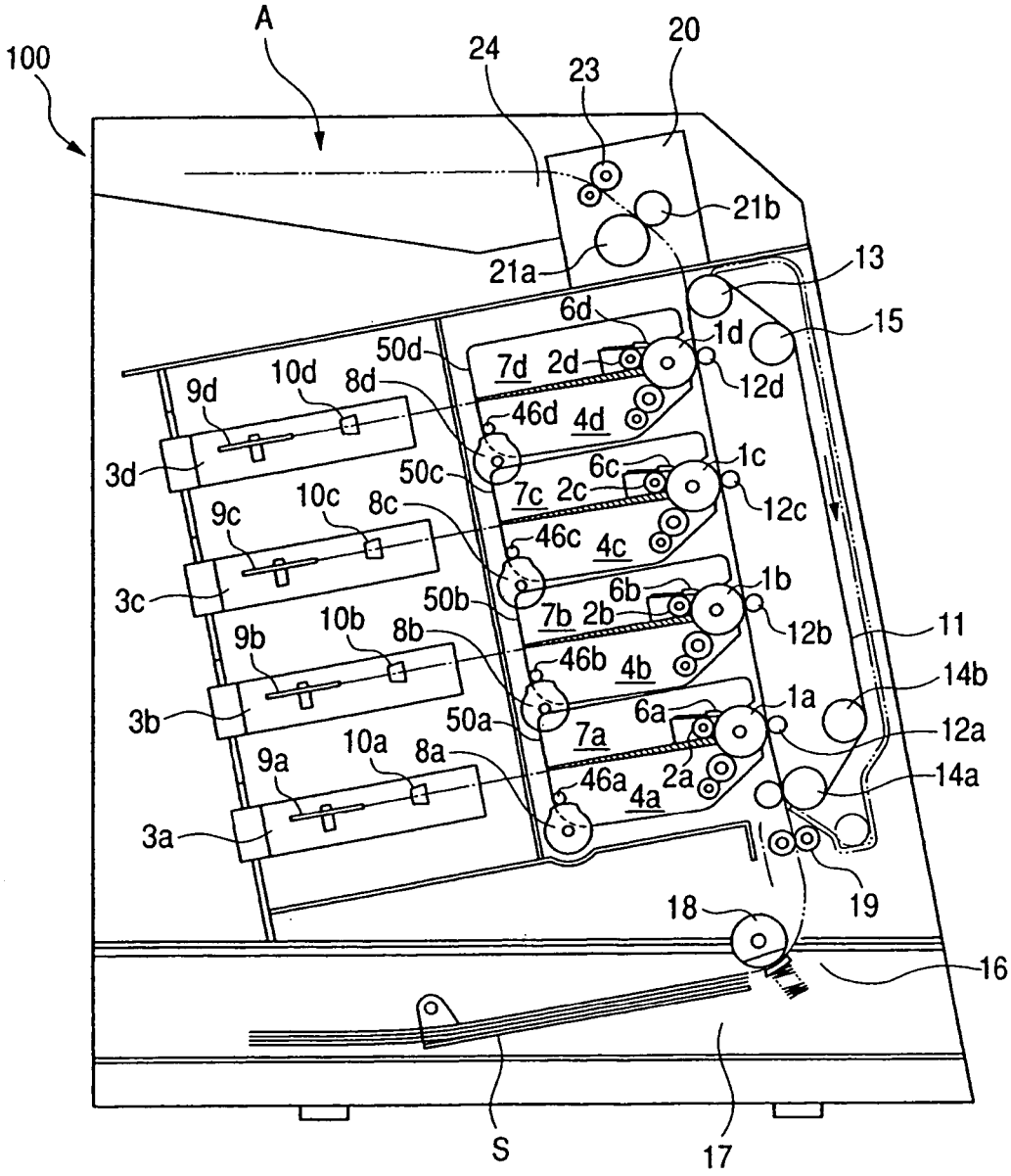
FIG. 1 is a diagram showing the general construction of a color electrophotographic image forming apparatus according to an embodiment of the present invention.
Figure 2:
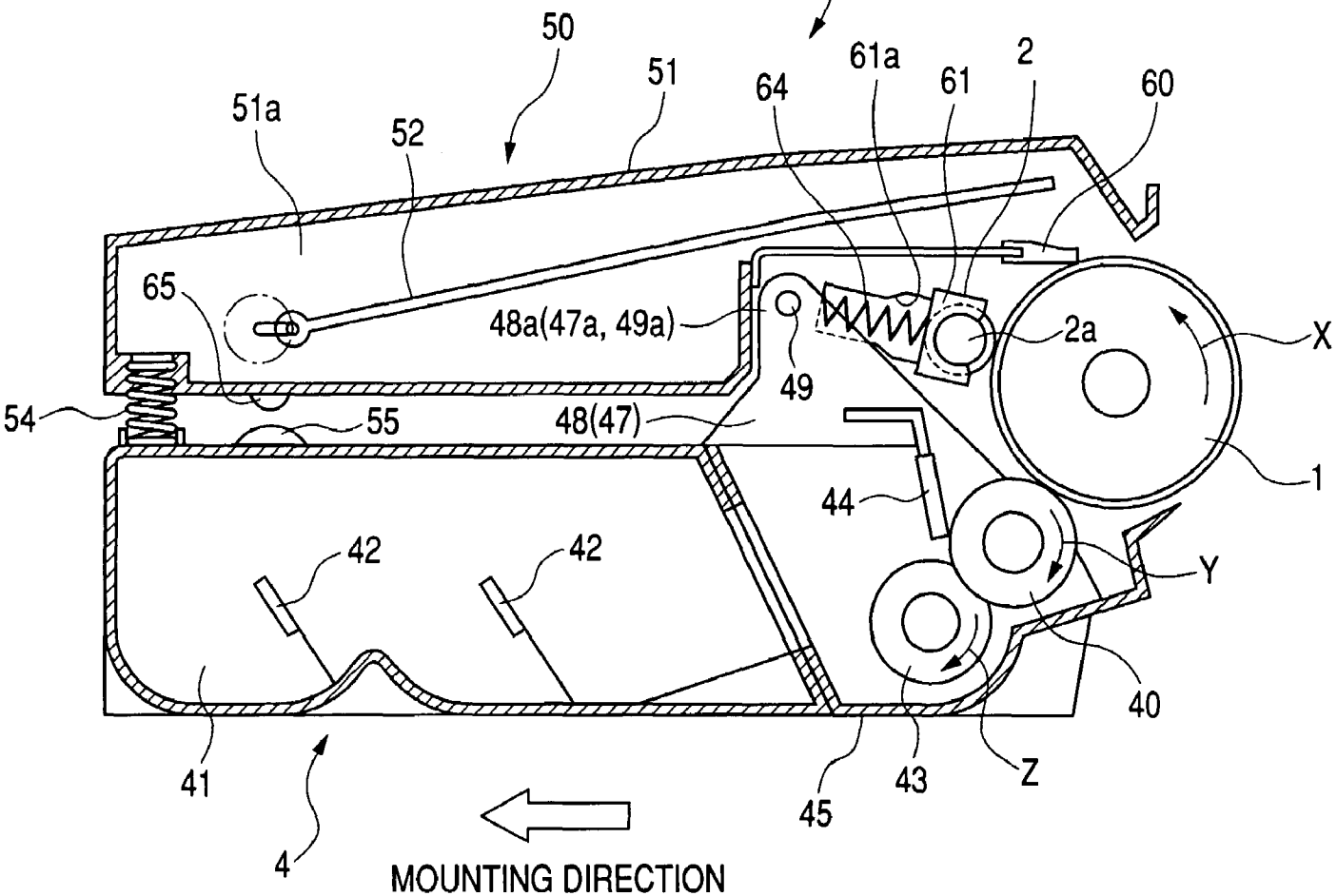
FIG. 2 is a schematic sectional view showing the construction of a process cartridge.
Figure 3:
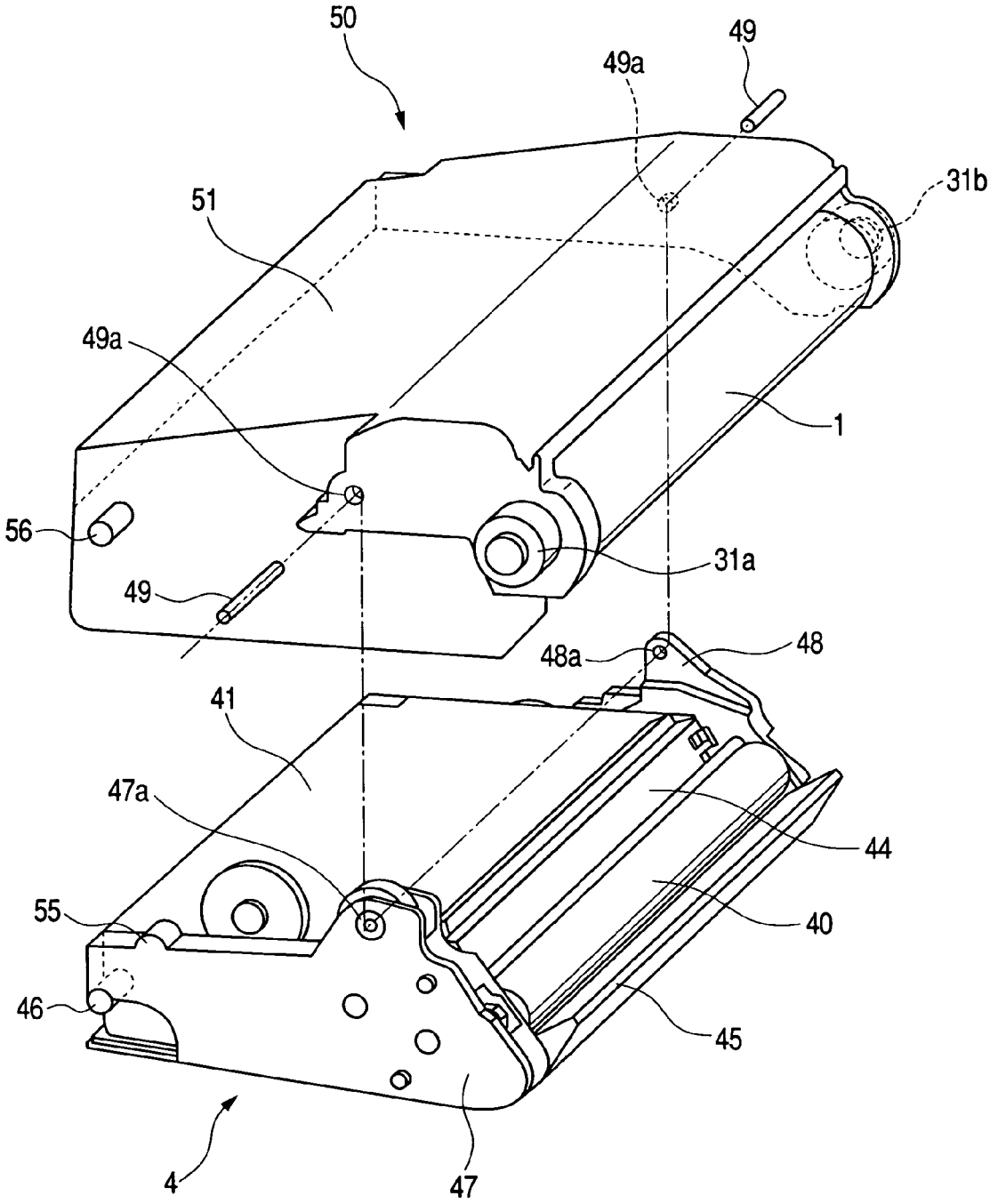
FIG. 3 is a perspective view showing a connecting structure of a process cartridge.

FIG. 1 is a diagram showing the general construction of a color electrophotographic image forming apparatus according to an embodiment of the present invention, FIG. 2 is an explanatory sectional view of a process cartridge, and FIG. 3 is a perspective view showing how the components of the process cartridge are put together.

(General Construction of the Image Forming Apparatus)

First, the general construction of an image forming apparatus will be described with reference to FIG. 1. An image forming apparatus 100, shown in FIG. 1, has four process cartridge attachment portions arranged side by side in the vertical direction, with each attachment portion having a developing roller separating means (8*a*, 8*b*, 8*c*, 8*d*) constituting a separating means. Then, each of cartridges 7 (7*a*, 7*b*, 7*c*, 7*d*) respectively attached to the attachment portions is equipped with a drum-like electrophotographic photosensitive member serving as an image bearing member, that is, a photosensitive drum 1 (1*a*, 1*b*, 1*c*, 1*d*) . Each photosensitive drum 1 is rotated counterclockwise as seen in FIG. 1 by a driving means (not shown). Around each photosensitive drum 1, the following components are arranged in the following order in the rotating direction.

Arranged around each photosensitive drum 1 are a charging means 2 (2*a*, 2*b*, 2*c*, 2*d*) serving as a charging member for uniformly charging the surface of the photosensitive drum 1, a scanner unit 3 (3*a*, 3*b*, 3*c*, 3*d*) for applying a laser beam based on image information to form an electrostatic latent image on the photosensitive drum 1, a developing unit 4 (4*a*, 4*b*, 4*c*, 4*d*) for forming a visible image, that is, a toner image by using toner constituting a developer for developing the electrostatic latent image, an electrostatic transfer means (12*a*, 12*b*, 12*c*, 12*d*) serving as an electrostatic transfer means for transferring the toner image on the photosensitive drum 1 to a recording medium S, and a cleaning means (6*a*, 6*b*, 6*c*, 6*d*) for removing toner remaining on the surface of the photosensitive drum 1 after transfer.

In this embodiment, the photosensitive drum 1, the charging means 2, the developing unit 4, and the cleaning means are integrated into a cartridge to form a process cartridge 7.

The photosensitive drum 1 is formed by coating the outer peripheral surface of an aluminum cylinder having a diameter, for example, of 30 mm with an organic photoconductor layer (OPC photosensitive member). The photosensitive drum 1 is rotatably supported at both ends by bearings 31*a* and 31*b* (FIG. 3). A drive force from a driving motor (not shown) is transmitted to one end portion of the photosensitive drum 1, whereby the photosensitive drum 1 is rotated counterclockwise (in the direction indicated by the arrow X in FIG. 2).

In this embodiment, the charging means 2 (2*a*, 2*b*, 2*c*, 2*d*) is a contact charging type as shown in FIG. 2. Specifically, the charging means 2 consists of a conductive roller formed into a roller shape, which is brought into contact with the surface of the photosensitive drum 1. Further, a charging bias voltage is applied to this charging roller 2, whereby the surface of the photosensitive drum 1 is uniformly charged.

Figure 4:
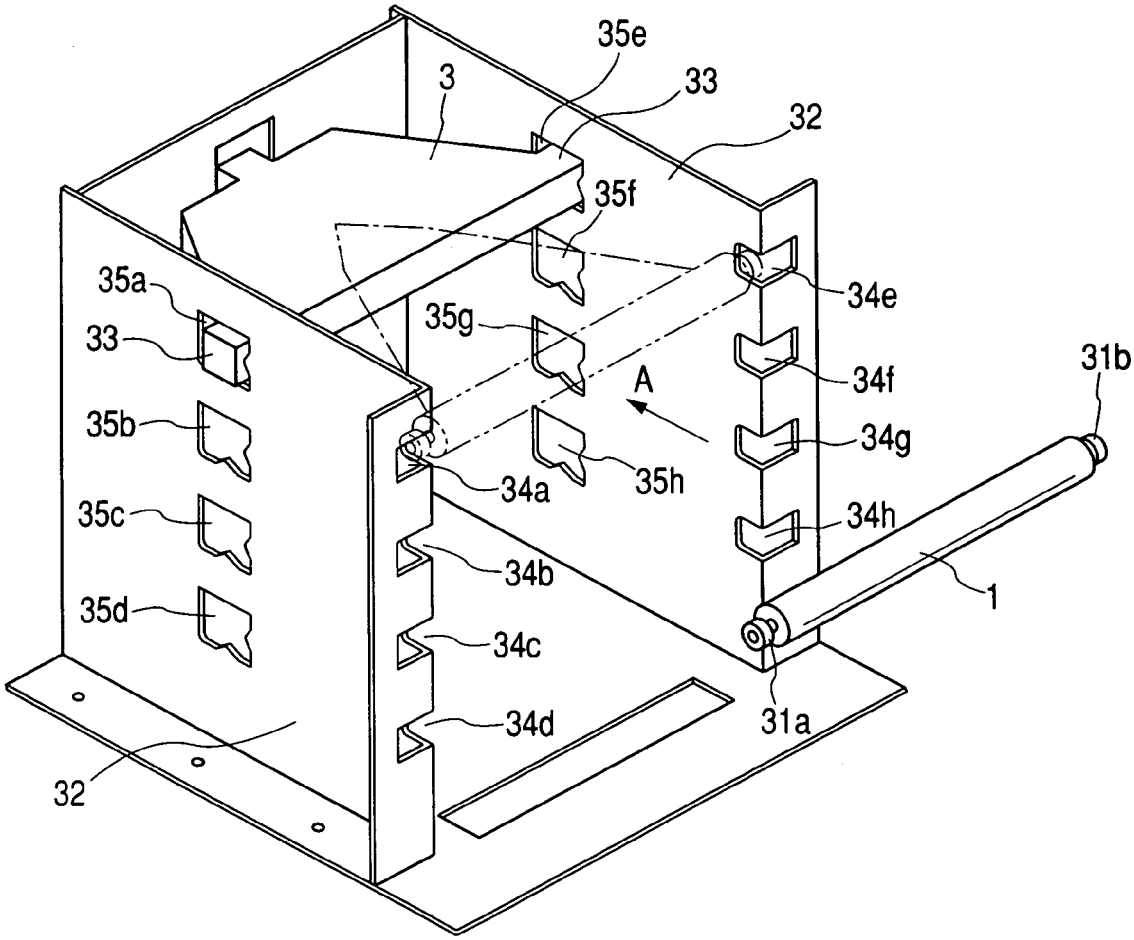
FIG. 4 is a diagram illustrating how a process cartridge is mounted to the main body of an image forming apparatus.
Figure 5:
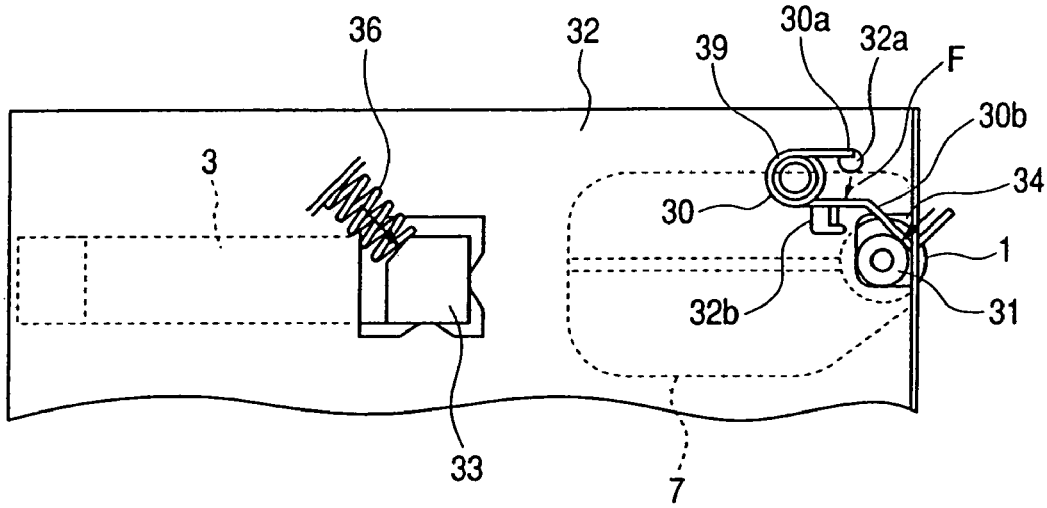
FIG. 5 is a diagram illustrating how a process cartridge is mounted to the main body of an image forming apparatus.

The scanner unit 3 (3*a*, 3*b*, 3*c*, 3*d*) is arranged substantially in the horizontal direction of the photosensitive drum 1. Image light corresponding to an image signal is applied by a laser diode (not shown) to a polygon mirror (9*a*, 9*b*, 9*c*, 9*d*) rotated by a scanner motor (not shown). The image light reflected by the polygon mirror is transmitted through an imaging lens (10*a*, 10*b*, 10*c*, 10*d*) for selective exposure of the charged surface of the photosensitive drum 1, whereby an electrostatic latent image corresponding to the image signal is formed. Further, as shown in FIG. 4, the longitudinal length of the unit 3 is larger than the distance between right and left side plates 32. As a result, protrusions 33 protrude from openings 35*a*, 35*b*, 35*c*, 35*d*, 35*e*, 35*f*, 35*g*, and 35*h* of the right and left side plates 32, wherein, as shown in FIG. 5, the unit 3 is pressurized downwards by approximately 45 degrees by a compression spring 36 with a force of approximately 9.8 N, whereby the unit 3 is reliably pressed against an abutment portion and positioning is effected thereon.

As shown in FIG. 1, in the image forming apparatus, there is arranged an electrostatic transfer belt 11 facing all the photosensitive drums 1*a* through 1*d* and circulating while being in contact therewith. The transfer belt 11 is a film-like member having a thickness of approximately 150 $\mu$m and a volume resistivity of $10^{11}$ to $10^{14}$ $\Omega\cdot$cm.

This transfer belt 11 is supported by four rollers arranged in the vertical direction. That is, the transfer belt 11 is stretched over four rollers: a driving roller 13, driven rollers 14*a* and 14*b*, and a tension roller 15, and runs in the direction indicated by the arrow in FIG. 1, whereby the transfer belt 11 circulates and the recording medium S is conveyed past the transfer positions upwards from below in FIG. 1.

The transfer rollers (12*a*, 12*b*, 12*c*, 12*d*) serving as the transfer means are held in contact with the inner side of the transfer belt 11 and arranged at positions opposed to the four photosensitive drums 1 (1*a*, 1*b*, 1*c*, 1*d*). An electric charge of positive polarity from the transfer rollers is applied to the recording medium S through the transfer belt 11, whereby the toner images on the photosensitive drums 1 are transferred to the recording medium S.

A feeding portion 16 serves to convey the recording medium S to an image forming portion. A plurality of recording media S are accommodated in a feeding cassette 17. At the time of image formation, a feeding roller 18 and a registration roller pair 19 rotate in accordance with the image forming operation. Accordingly, the recording media within the feeding cassette 17 are separated and fed sheet by sheet. Then, the leading edge of the recording medium S abuts against the registration roller pair 19 and stops temporarily. After that, in synchronism with the running of the transfer belt 11 and the toner images, the recording medium S is fed to the transfer belt 11 by the registration roller pair 19.

A fixing portion 20 serves to fix toner images in a plurality of colors transferred to the recording medium S. The fixing portion 20 has a heating roller 21*a* that rotates, and a pressurizing roller 21*b* in pressure contact therewith and adapted to apply heat and pressure to the recording medium S. That is, the recording medium S, to which the toner images on the photosensitive drums 1 have been transferred, is conveyed by the fixing roller pair (21*a*, 21*b*) when passing the fixing portion 20. Then, heat and pressure are imparted thereto by the fixing roller pair 21, whereby the toner images in a plurality of colors are fixed to the surface of the recording medium S.

The image forming operation in the image forming apparatus of this embodiment is as follows.

First, the cartridges 7 (7*a*, 7*b*, 7*c*, 7*d*) are successively driven timed with the image formation. In accordance with the driving, the photosensitive drums 1 (1*a*, 1*b*, 1*c*, 1*d*) are rotated. Then, the scanner units 3 (3*a*, 3*b*, 3*c*, 3*d*) respectively corresponding to the cartridges 7 (7*a*, 7*b*, 7*c*, 7*d*) are successively driven. By this driving, the charging rollers 2 (2*a*, 2*b*, 2*c*, 2*d*) impart uniform electric charge to the surfaces of the photosensitive drums 1. After that, the scanner units 3 perform exposure on the surfaces of the photosensitive drums 1 according to the image signal to form electrostatic latent images on the photosensitive drums 1. Developing rollers 40 serving as the developing members develop the electrostatic latent images.

As stated above, the toner images on the photosensitive drums 1 are successively transferred to the recording medium S by an electric field formed between the photosensitive drums 1 and the transfer rollers 12. The recording medium S, to which the toner images in four colors have been transferred, is separated from the transfer belt 11, and then conveyed to the fixing portion 20. After the toner images are fixed thereto by heat in the fixing portion 20, the recording medium S is discharged to the exterior of the main body through a discharging portion 24 by a discharging roller 23.

(Process Cartridge)

Next, the process cartridges 7 (7*a*, 7*b*, 7*c*, 7*d*) of the present invention will be described with reference to FIGS. 2 and 3.

In this embodiment, the cartridge 7*a* containing yellow toner, the cartridge 7*b* containing magenta toner, the cartridge 7*c* containing cyan toner, and the cartridge 7*d* containing black toner are of the same construction.

According to this embodiment, each of the cartridges 7 (7*a*, 7*b*, 7*c*, 7*d*) is composed of a photosensitive member unit 50 as a first unit equipped with the charging roller 2 (2*a*, 2*b*, 2*c*, 2*d*) and the cleaning means (6*a*, 6*b*, 6*c*, 6*d*), and a developing unit 4 (4*a*, 4*b*, 4*c*, 4*d*) as a second unit having the developing roller 40. In this way, the photosensitive drum and the developing roller are provided in different units, whereby it is possible to easily provide a toner seal for preventing leakage of toner from the process cartridge during the shipment thereof.

In the photosensitive member unit 50, the photosensitive drum 1 is rotatably mounted to a cleaning frame 51 through the intermediation of the bearings 31*a* and 31*b*. Arranged in the periphery of the photosensitive drum 1 are a primary charging roller 2 for uniformly charging the surface of the photosensitive drum 1 and a cleaning blade 60 serving as a cleaning means for removing the developer (toner) remaining on the photosensitive drum 1.

The residual toner removed from the surface of the photosensitive drum 1 by the cleaning blade 60 is sent to a removed toner chamber 51*a*, provided at the rear of the cleaning frame, by a toner feeding mechanism 52. Then, by transmitting the drive force of the driving motor (not shown) to the photosensitive member unit 50, the photosensitive drum 1 is rotated in the direction indicated by the arrow X (counterclockwise) in accordance with the image forming operation.

The charging member serves to charge the surface of the photosensitive drum 1. In this embodiment, a so-called contact charging method as disclosed in JP 63-149669 A is employed. That is, the charging roller 2 is provided as the charging member in the cleaning frame 51 so as to be rotatable by slide bearings 61. The charging roller 2 is formed by providing an elastic rubber layer consisting of EPDM, NBR, or the like on a metal roller shaft 2*a* (for example, a conductive core formed of iron, SUS, or the like), and, further, providing on the peripheral surface thereof a urethane rubber layer in which carbon is dispersed, or coating the metal roller shaft with a foam urethane rubber layer in which carbon is dispersed. The roller shaft 2*a* of the charging roller 2 is mounted through the intermediation of the slide bearings 61 so as to be slidable toward the photosensitive drum 1 along a guide 61*a* provided inside the cleaning frame 51. Further, the charging roller 2 is urged toward the photosensitive drum 1 by a pressurizing spring 64 provided in a compressed state between the bearings 61 supporting the roller shaft 2*a* and the cleaning frame 51, and is thereby held in pressure contact with the surface of the photosensitive drum 1, whereby it rotates following the photosensitive drum 1. Further, at least one of the bearings 61 is formed of a conductive material, so that the surface of the photosensitive drum 1 is uniformly charged by applying a predetermined charging bias to the charging roller 2.

As will be seen with reference also to FIG. 2, each developing unit 4 (4*a*, 4*b*, 4*c*, 4*d*) has a developer containing portion containing developer (toner), that is, a toner container 41, and a developing frame, that is, a developing container 45.

That is, regarding the toner container 41, the yellow developing unit 4*a* has a toner container containing yellow toner, the magenta developing unit 4*b* has a toner container containing magenta toner, the cyan developing unit 4*c* has a toner container containing cyan toner, and the black developing unit 4*d* has a toner container containing black toner. In each toner container 41, there is arranged the developing roller 40 opposed to the photosensitive drum 1 and serving as the developing member for carrying and conveying the developer.

The developing roller 40 is rotatably supported by a developing frame 45 through the intermediation of bearing members 47 and 48, and rotates in the direction indicated by the arrow Y while in contact with the photosensitive drum 1.

Further, as stated above, in the periphery of the developing roller 40, there are arranged a toner supply roller 43

(rotating in the direction indicated by the arrow Z), and a developing blade 44. Further, inside toner container 41, there is provided a toner conveying mechanism 42 for agitating the toner contained and conveying the toner to the toner supply roller 43. Further, at either end of the developing roller 40, there is arranged a spacer member (not shown) whose outer periphery is held in contact with the photosensitive drum 1 to thereby regulate the amount by which the developing roller 40 is held in pressure contact with the photosensitive drum 1 to a predetermined amount.

The developing unit 4 has a suspension structure in which the entire developing unit 4 is supported so as to be swingable with respect to the photosensitive member unit 50. That is, the developing unit 4 is connected to the photosensitive member unit 50 so as to be rotatable around shafts 49 fitted into holes 47*a* and 48*a* respectively provided in the bearing members 47 and 48 mounted to the ends of the unit 4. As shown in FIG. 3, the shafts 49 are firmly attached to holes 49*a* formed in the photosensitive member unit 50.

Further, when the cartridge 7 is alone (i.e., in the state in which it is not attached to the apparatus main body 100), the developing unit 4 is constantly urged so as to rotate counterclockwise as seen in FIGS. 2 and 7 around the shafts 49 by a pressurizing spring 54 (compression spring) and a pressurizing spring 53 (extension spring: see FIG. 11) serving as pressurizing members so that the developing roller 40 may be held in contact with the photosensitive drum 1 by a rotation moment.

Further, as will be seen with reference to FIGS. 3 and 7A, the bearing members 47 and 48 of the developing unit 4 are integrally equipped with force receiving portions 46 for a cam 80 of a developing roller separating means (described in detail below) to abut when separating the developing roller 40 from the photosensitive drum 1. The force receiving portions 46 are formed on the bearing members 47 and 48 at positions in the rear portion of the developing unit 4, that is, in the upstream portion of the toner container 41 with respect to the toner conveyance. Further, the shafts 49 are arranged so as to be situated between the force receiving portions 46 and the developing roller 40.

As shown in FIG. 3, regulating portions 56 are provided on both side surfaces of the photosensitive member unit 50, and, in the state in which the process cartridge 7 has been inserted into the image forming apparatus main body 100, the regulating portions 56 are restrained to restraining portions 90 (FIG. 13) provided on both side plates of the apparatus main body 100, regulating upward movement of the photosensitive member unit 50. Further, by pushing up the force receiving portions 46, the developing roller 40 is spaced apart from the photosensitive drum 1 by a predetermined gap (see FIG. 8).

In the contact developing system, in which development is effected with the photosensitive drum 1 and the developing roller 40 being held in contact with each other, it is desirable for the photosensitive drum 1 to be a rigid member and for the developing roller 40 to be a roller having an elastic member. As the elastic member, there is employed a solid rubber single layer, a solid rubber layer coated with resin, taking into account the requisite property for imparting charge to toner, or the like.

Next, the construction of the charging member releasing means, which constitutes a feature of the present invention, will be described with reference mainly to FIG. 7. In this embodiment, the charging member releasing means also serves as a charging member moving means.

Figure 10:
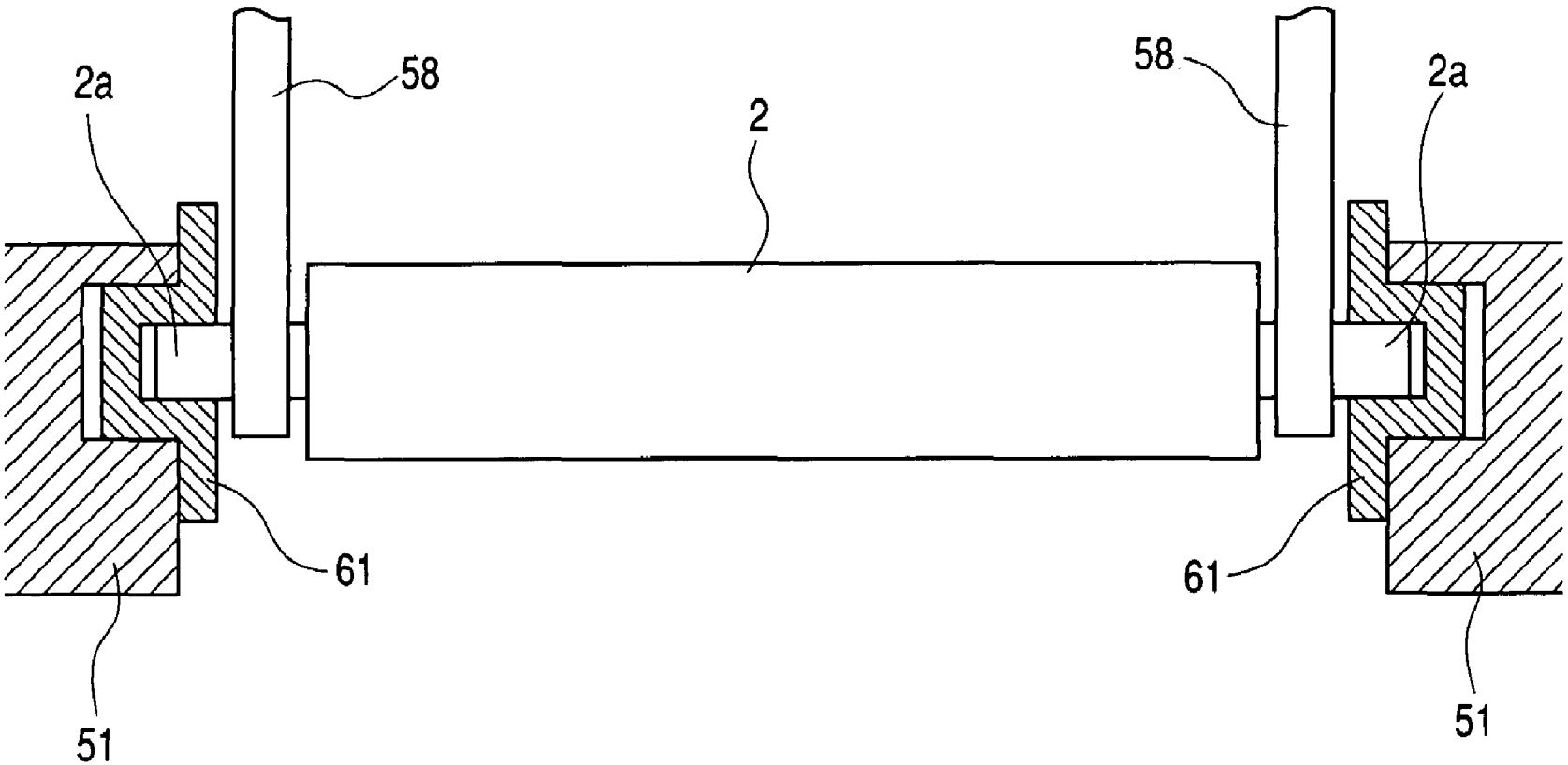
FIG. 10 is a front view showing a support structure for a charging roller.

First, as shown in FIG. 10, at either end of the charging roller 2, one end of a link 58 is connected to the roller shaft 2*a* portion between the rubber portion and the slide bearing 61. As can be seen from FIGS. 7A and 7B, the other end of each link 58 is connected to a crank 57 provided inside the cleaning frame 51.

Each crank 57 is rotatably connected to a shaft 59 fitted into a bearing hole (not shown) formed in the cleaning frame 51. As shown in FIG. 7A, the bearing hole for the shaft 59 is provided on the opposite side of the photosensitive drum 1, with the developing unit swinging center shaft 49 being therebetween.

The crank 57 has two arms 57*a* and 57*b* extending radially from the rotation center formed by the shaft 59. The angle ($\alpha$) made by the two arms 57*a* and 57*b* is substantially a right angle. The distal end of the first arm 57*a* is rotatably connected to one end of the link 58 through the intermediation of a connection shaft 63. The second arm 57*b* has at its distal end an action receiving portion 65 in the form of a downwardly directed protrusion.

Figure 7A:
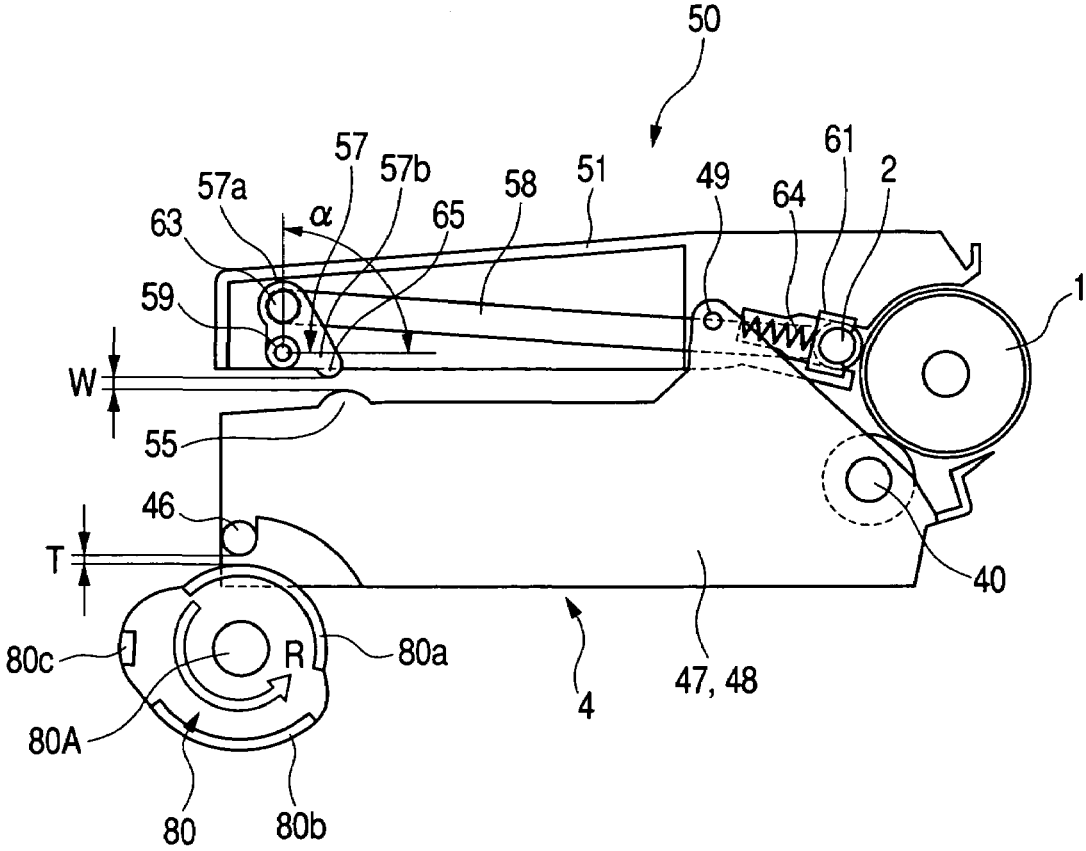
FIG. 7A is a side view illustrating a mechanism for separating a charging roller and a developing roller from a photosensitive drum, showing a state (first swinging attitude) in which the charging roller and the developing roller are held in contact with the photosensitive drum.
Figure 7B:
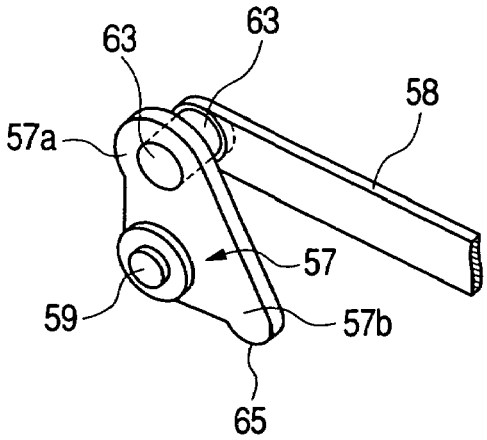
FIG. 7B is a perspective view showing how a crank and a link are mounted.

Thus, by pushing up the action receiving portions 65, the cranks 57 rotate counterclockwise as seen in FIG. 7A, whereby the links 58 pulls both ends of the charging roller 2 to the left as seen in FIG. 7A, and the contact pressure of the charging roller 2 with respect to the photosensitive drum 1 is gradually reduced, until the charging roller is separated from the photosensitive drum 1.

Figure 8:
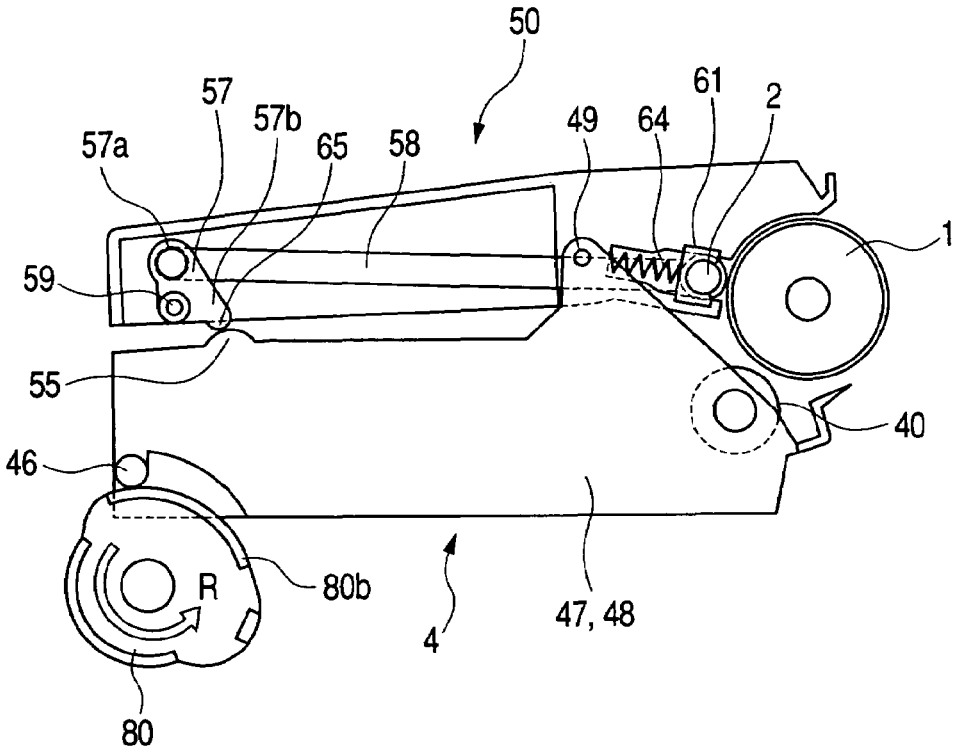
FIG. 8 is a side view showing a state (second swinging attitude) in which the charging roller is held in contact and the developing roller is held out of contact with the photosensitive drum.

The bearing member 47, 48 of the developing unit 4 has at a position opposed to the action receiving portion 65 an acting portion 55 in the form of a protrusion. When the developing roller 40 is in contact with the photosensitive drum 1 (as shown in FIG. 7A), a gap W of several mm is provided beforehand between the action receiving portion 65 and the acting portion 55. When the force receiving portion 46 receives a force from a cam 80 of the apparatus main body 100, solely the developing roller 40 is first separated from the photosensitive drum 1, and, at the same time, the acting portion 55 moves upwards (as shown in FIG. 8). At this time, the charging roller 2 and the photosensitive drum 1 are still in contact with each other. This position of the charging roller 2 will be referred to as a first position.

Figure 9:
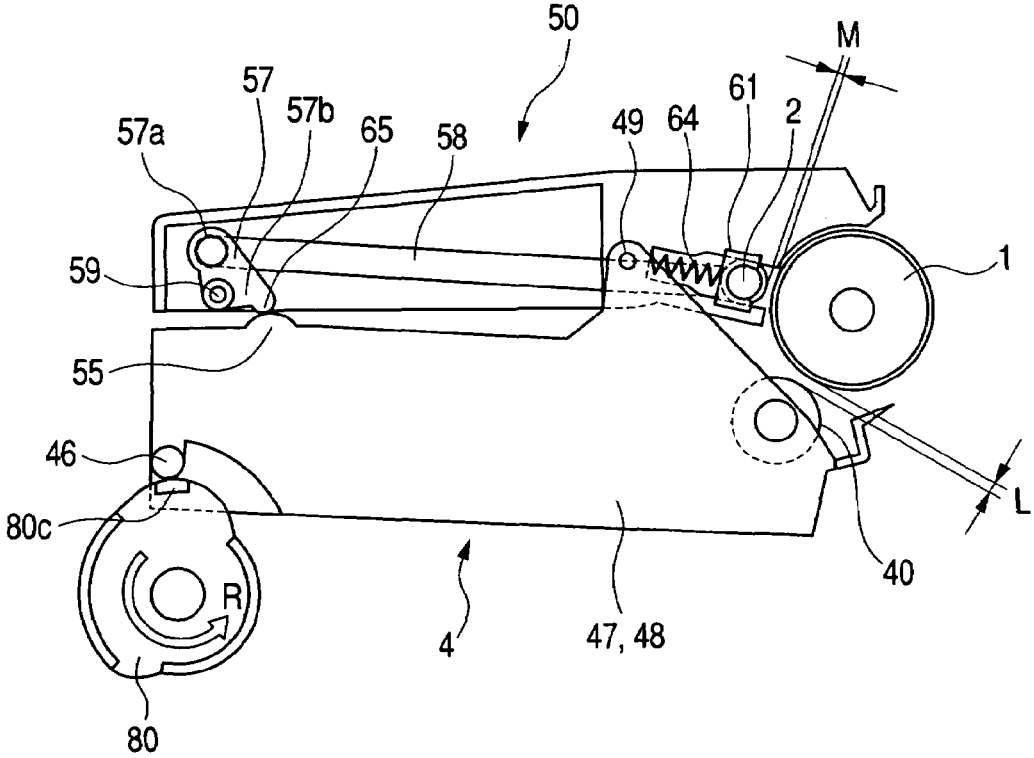
FIG. 9 is a side view showing a state (third swinging attitude) in which both the charging roller and the developing roller are separated apart from the photosensitive drum.

When the force receiving portion 46 is further pushed up, the acting portion 55 pushes up the action receiving portion 65, and the contact pressure of the charging roller 2 with respect to the photosensitive drum 1 is reduced, until the charging roller is separated from the photosensitive drum 1 (as shown in FIG. 9). This position at which the contact pressure of the charging roller 2 with respect to the photosensitive drum 1 is lower than that at the first position or the position at which the charging roller 2 is spaced apart from the photosensitive drum 1 will be referred to as a second position.

In this embodiment, the force receiving portion 46 on which the cam 80 acts, and the acting portion 55 in contact with the action receiving portion 65 constituting a part of the charging member releasing means are provided on each of the bearing members 47 and 48. The positions where the force receiving portion 46 and the acting portion 55 are provided are not restricted to those described above; it is also possible, for example, to provide them on the developing frame 45. However, as in this embodiment, by mounting the developing roller 40 to the bearing members 47 and 48, it is possible to minimize deflection of the components and variation in dimensional tolerance etc. Thus, the accuracy and responsiveness of the developing roller 40 and the charging roller 2 with respect to the input from the cam 80 are satisfactory, so that the stroke at the time of separation can be made a minimum one required, and it is possible to increase the paper passing speed, with the result that the printing speed can be increased.

(The Mechanism for Separating the Photosensitive Drum from the Developing/Charging Members of the Process Cartridge Inside the Apparatus Main Body)

Next, the separating mechanism to be used when the process cartridge 7 is attached to the apparatus main body 100 is discussed with reference to FIGS. 4 through 9.

Figure 6:
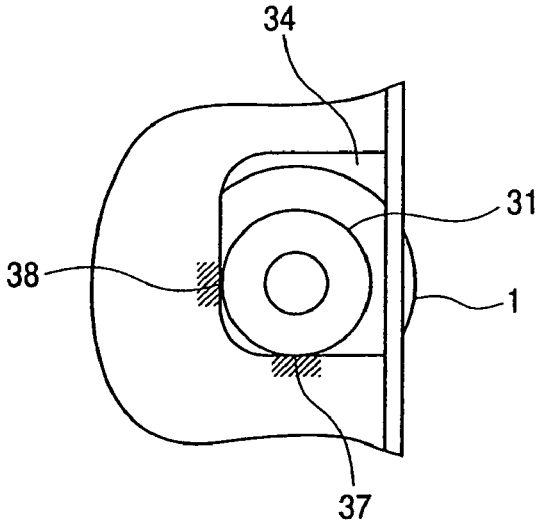
FIG. 6 is a diagram illustrating how a process cartridge is mounted to the main body of an image forming apparatus.

FIGS. 4 through 6 are diagrams illustrating how the process cartridge is attached to the image forming apparatus main body, FIG. 7A is a diagram showing the state in which both the developing roller 40 and the charging roller 2 are in contact with the photosensitive drum 1 (first swinging attitude), FIG. 8 is a diagram showing the state in which the developing roller 40 is spaced apart from the photosensitive drum 1 while the charging roller 2 is in contact therewith (second swinging attitude), and FIG. 9 is a diagram showing the state in which both the developing roller 40 and the charging roller 2 are spaced apart from the photosensitive drum 1 (third swinging attitude).

First, the attachment of the process cartridge 7 to the apparatus main body 100 is effected by inserting the bearings 31 (31*a* and 31*b*) supporting both ends of the drum shaft of the photosensitive drum 1 in each cartridge 7 along guide grooves 34 (34*a*, 34*b*, 34*c*, 34*d*, 34*e*, 34*f*, 34*g*, and 34*h*). In FIG. 4, the attachment direction for the process cartridge 7 is indicated by the arrow A. Then, as shown in FIG. 6, the bearings 31 are pressed against abutment surfaces 37 and 38 of the guide grooves 34, whereby positioning of the process cartridge 7 with respect to the apparatus main body 100 is effected.

The method pressurizing the process cartridge 7 inside the image forming apparatus main body 100 is as follows.

As shown in FIG. 5, a shaft 39 is crimped to apparatus main body side plates 32, and a helical torsion spring 30 is supported by the shaft 39. One end portion 30*a* of the spring 30 is fitted into a hole 32*a* for fixation, and the other end portion 30*b* is bent into a V-shape and abuts the bearings 31 (31*a* and 31*b*). In the state in which the cartridge 7 has not been attached yet, the other end portion 30*b* of the spring 30 abuts a raised portion 32*b*, whereby its movement in the rotating direction is regulated. When the process cartridge 7 is inserted, the spring 30 receives a raising force from the bearing 31, and rotates counterclockwise against the spring force. When the bearing 31 gets over the V-shaped end portion 30*b*, the bearing 31 is elastically pressurized.

At this time, as stated above, the regulating portions 56 on both side surfaces of the photosensitive member unit 50 are restrained to the restraining portions 90 provided on both side surfaces of the image forming apparatus main body 100, so that upward movement of the photosensitive member unit 50 when the force receiving portions 46 are pushed up by the action of the cam 80 is regulated.

As shown in FIGS. 7A, 8, and 9, on the inner side of the apparatus main body 100 with respect to the inserting direction of the cartridge 7, there is arranged the cam 80 for separating the developing roller 40 from the photosensitive drum 1 against the urging force of the developing unit 4.

The cam 80 consists of cams 80 of the same configuration and the same phase connected to both longitudinal ends of a rotation shaft 80A. The cam 80 has a three-stage structure composed of a portion 80*a* with minimum radius, a portion 80*b* with medium radius, and a portion 80*c* with maximum radius. In this embodiment, the states in which these stages are at the top are respectively referred to as lower, middle, and higher positions.

In this embodiment, the radius of the minimum-radius portion 80*a* of the cam 80 is such that, in the state in which the developing roller 40 is in contact with the photosensitive drum 1, there is a gap T between it and the force receiving portion 46; the medium-radius portion 80*b* is such that, while it is in contact with the force receiving portion 46, there is a gap W between the acting portion 55 of the bearing members 47 and 48 and the action receiving portion 65. Then, the radius of the maximum-radius portion 80*c* is such that it is in contact with the force receiving portion 46 and that the acting portion 55 of the bearing members 47 and 48 is in contact with the action receiving portion 65, that is, T=W=0.

The cam 80 is provided for each of the cartridges 7 of the colors of yellow, magenta, cyan, and black; they are drive-branched from one stepping motor (not shown) by gear connection, each being rotation-controlled in synchronism.

Further, the cam 80 is always rotated in the direction indicated by the arrow R in FIG. 7A. Due to this rotating direction, the photosensitive drum 1 is pulled rearwards, i.e., to the left as seen in FIG. 7A, that is, in the direction opposite to the transfer belt 11. Thus, no load or impact is applied to the transfer belt 11, which is advantageous from the viewpoint of misregister (in color).

As shown in FIG. 9, when the image forming apparatus main body 100 is at rest, the cam 80 is in the higher position mentioned above. At this time, the force receiving portion 46 is pushed up by the acting portion 80*c* of the cam 80, and the developing roller 40 is spaced apart from the photosensitive drum 1 by a distance L as shown in FIG. 9. Then, the action receiving portion is also pushed up by the acting portion 55 of the bearing members 47 and 48, and the charging roller 2 is also spaced apart from the photosensitive drum 1 by a distance M as shown in FIG. 9.

In this way, when the apparatus main body 100 is at rest, the cam 80 acts on the force receiving portion 46, and the developing unit 4 assumes the third swinging attitude (the state as shown in FIG. 9), whereby both the developing roller 40 and the charging roller 2 are spaced apart from the photosensitive drum 1. Thus, even if the process cartridge 7 attached to the image forming apparatus main body 100 is left unused for a long period of time, the elastic layer does no undergo permanent deformation, so that it is possible to avoid generation of transversal streaks in the image at an interval corresponding to the roller cycle.

While in this embodiment the charging roller 2 is spaced apart from the photosensitive drum 1 when the apparatus main body is at rest, if, as another embodiment, the contact pressure is lowered without achieving complete separation, it is also possible to achieve the same satisfactory effect as described above.

Further, while in this embodiment it is possible to assume all of the first, second, and third swinging attitudes due to the cam 80, it is also possible to adopt a construction in which it is possible to assume the first and second swinging attitudes by the cam 80, the third swinging attitude being assumed by means of a hook 66 described below.

Next, when image forming operation is started by a print signal, the cam 80 rotates, in synchronism with the developing operation, in the direction indicated by the arrow R in FIG. 9 so as to assume the attitude shown in FIG. 7A, that is, the lower position mentioned above. In this state, the force receiving portion 46 is spaced apart from the cam 80, and the developing roller 40 is pressed against the photosensitive drum 1 with a predetermined pressure by the elastic force of the urging springs 53 and 54. Then, the action receiving portion 65 is spaced apart from the acting portion 55, and the charging roller 2 is pressed against the photosensitive drum 1 with a predetermined pressure by the elastic force of the pressurizing spring 64. That is, the cam 80 is spaced apart from the force receiving portion 46, and the developing unit 4 assumes the first swinging attitude, whereby both the developing roller 40 and the charging roller 2 are held in contact with the photosensitive drum 1, making it possible to perform image formation.

In the cartridge attitude during image forming operation, there is a gap W between the action receiving portion 65 and the acting portion 55, so that, during transition from the stop state to the start of image forming operation, the charging roller 2 always comes into contact with the photosensitive drum 1 first, and then the developing roller 40 comes into contact with the photosensitive drum 1. When the image forming operation has been completed, the developing roller 40 and the charging roller 2 are spaced apart from the photosensitive drum 1 again; in this process, the developing roller 40 is always separated from the photosensitive drum 1 first, and then the charging roller 2 is separated from the photosensitive drum 1.

Due to this contact order, while the developing roller 40 is in contact with the photosensitive drum 1, it is possible to maintain a state in which uniform electric charge is imparted to the surface of the photosensitive drum 1. If, conversely, the charging roller 2 is separated from the photosensitive drum 1 earlier than the developing roller 40, the toner on the developing roller 40 is inadvertently borne by the surface of the photosensitive drum 1, resulting in an image defect such as fog. Here, the charging roller 2 in the second swinging attitude is brought into contact with the photosensitive drum 1 to start to charge the photosensitive drum 1. When, as a result of rotation of the photosensitive drum 1, the charged region of the photosensitive drum 1 reaches the position where it faces the developing roller 40, switching to the first swinging attitude is effected to bring the developing roller 40 into contact with the photosensitive drum 1. That is, when the developing roller 40 comes into contact with the photosensitive drum 1, it is so arranged that the region already charged by the charging roller 2 comes into contact, whereby it is possible to reliably prevent fogging of toner from the developing roller 40 to the photosensitive drum 1.

Further, in this embodiment, programming is effected such that a process for correcting image density is effected when the process cartridge 7 is attached to the image forming apparatus 100 or each time the apparatus has been used a predetermined number of times. In the above-mentioned process, a toner image is directly transferred to the surface of the electrostatic transfer belt 11, and the density of the image is detected by a density detection sensor, the potential at each image forming process being corrected in accordance with the density value. After the completion of the detection, an electric field is formed so that the toner on the electrostatic transfer belt 11 may return to the photosensitive drum 1, the toner on the surface of the photosensitive drum 1 being accommodated in the removed toner chamber 51*a* of the cleaning frame 51. In the process of removing the toner on the surface of the electrostatic transfer belt 11, it is necessary for the developing roller 40 to be spaced apart while charging the surface of the photosensitive drum 1. If, in this process, the developing roller 40 is brought into contact with the photosensitive drum 1, much of the toner on the surface of the developing roller 40 will be borne by the surface of the photosensitive drum 1 due to the electric field between the developing roller 40 and the photosensitive drum 1, resulting in waste of toner. Thus, as shown in FIG. 8, in this process, the cam 80 acts on the force receiving portion 46 and the developing unit 4 assumes the second swinging attitude, whereby the developing roller 40 is spaced apart from the photosensitive drum 1, and the charging roller 2 is held in contact therewith.

As stated above, the construction in which the developing roller 40 and the charging roller 2 can be separated as needed makes it possible to restrain toner consumption due to generation of image defect or fog caused by permanent deformation of the elastic member; further, it is effective in preventing the developing roller 40 from rotating more than necessary. In particular, in the case of the process cartridge 7 in a color electrophotographic image forming apparatus, the developing roller 40 is rotating while in contact with the photosensitive drum 1 and the toner supply roller 43, so that, as the developing roller 40 rotates, the toner deteriorates at the contact portions. Thus, in the construction of this embodiment, in which it is possible to minimize the rotating time of the developing roller 40, it is possible to prevent image defect due to deterioration in the toner or toner leakage.

(The Construction for Separating the Photosensitive Drum from the Developing/Charging Rollers During Shipment of the Process Cartridge and the Construction for Canceling the Separation)

Figure 11:
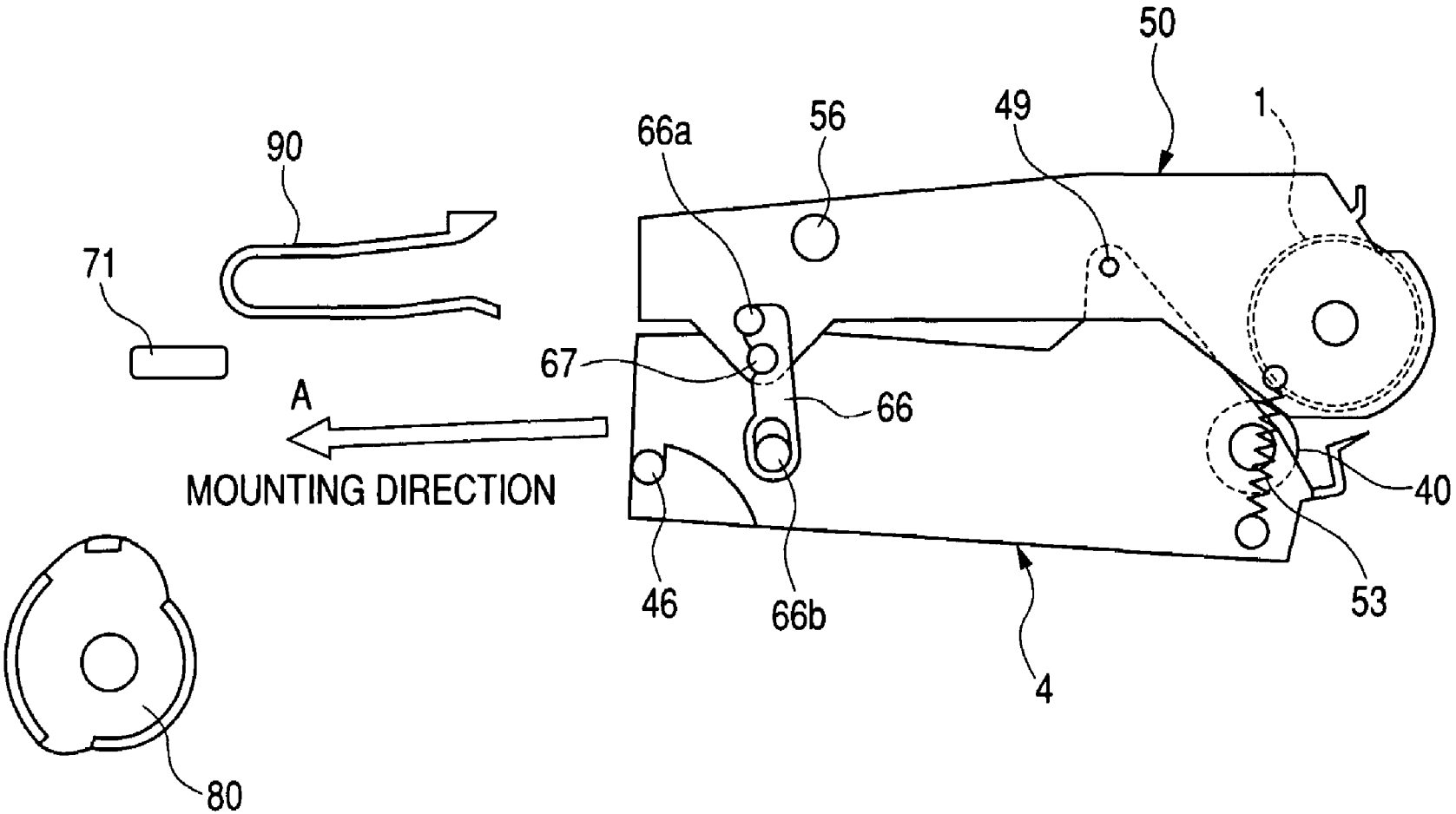
FIG. 11 is a side view of a process cartridge, illustrating how it is inserted into the main body of an image forming apparatus.
Figure 12:
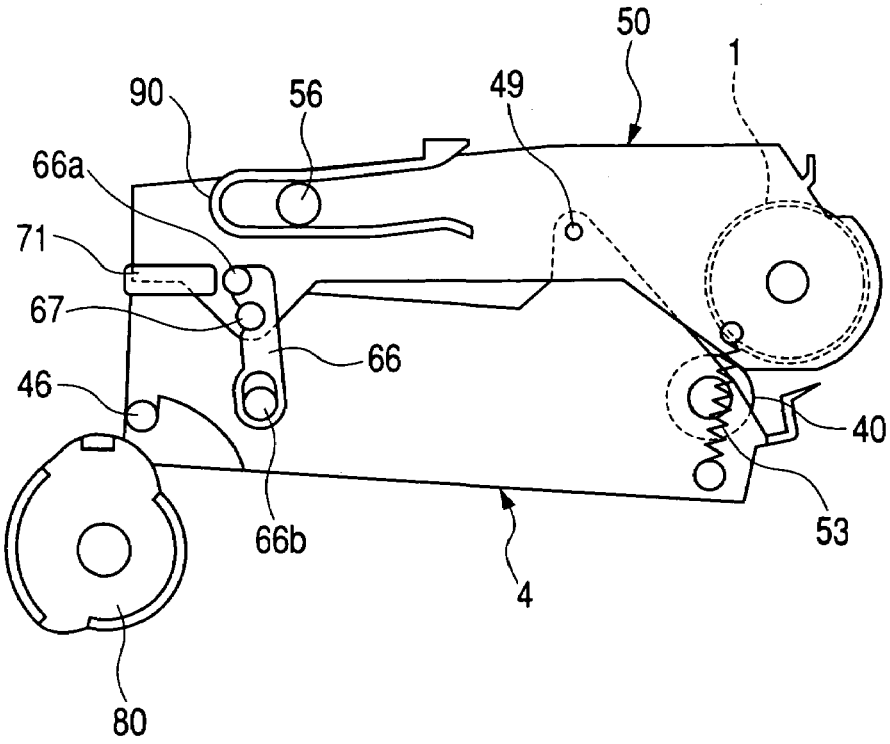
FIG. 12 is a side view of a process cartridge, illustrating how it is inserted into the main body of an image forming apparatus.

Next, a construction for separating the photosensitive drum 1 from the developing roller 40 and the charging roller 2 during shipment of the process cartridge 7 and a construction for canceling the separation will be described with reference to FIGS. 11 through 13.

Figure 13:
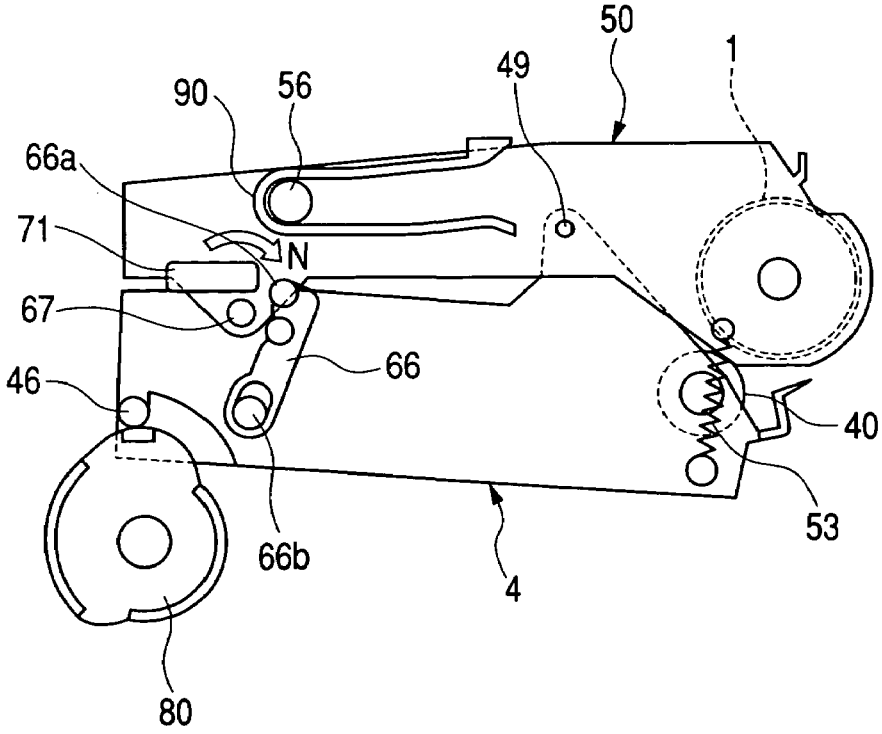
FIG. 13 is a side view of a process cartridge, illustrating how it is inserted into the main body of an image forming apparatus.

As shown in FIG. 13, a hook 66 is mounted to a side surface of the developing unit 4 so as to be rotatable around a shaft 66*b*. On the other hand, the photosensitive member unit 50 has, on the same side as the bearing member 47, a protrusion 67 with which the hook 66 is to be engaged. The protrusion 67 is situated such that in the state in which the hook 66 is engaged, the acting portion 55 pushes up the action receiving portion 65, that is, the developing unit 4 assumes the third swinging attitude. Thus, during shipment of the process cartridge, the hook 66 is engaged with the protrusion 67, so that both the developing roller 40 and the charging roller 2 are maintained in the state in which they are spaced apart from the photosensitive drum 1. That is, the hook 66 and the protrusion 67 constitute attitude maintaining members for maintaining the second frame, that is, the developing unit 4, in the third swinging attitude.

The hook 66 has at its distal end a force receiving portion 66*a*, and the apparatus main body 100 has halfway through the insertion guide (not shown) a protrusion 71 acting on the force receiving portion 66*a*. Then, as the process cartridge 7 is inserted from the position of FIG. 11 into the apparatus main body 100 in the direction indicated by the arrow A, the force receiving portion 66*a* abuts the protrusion 71 at the position of FIG. 12, and the hook 66 rotates in the direction indicated by the arrow N in FIG. 13 to be thereby detached from the protrusion 67, bringing the developing unit 40 into the state in which it can swing with respect to the photosensitive member unit 50. When, thereafter, the process cartridge is 7 is further inserted in the direction indicated by the arrow A, the regulating portions 56 of the photosensitive member unit 50 are restrained by the restraining portions 90 provided on both side plates of the image forming apparatus main body 100 as shown in FIG. 13, and the force receiving portions 46 of the developing unit 40 ride on the acting portions 80*c* of the cams 80 serving as the separating means, thus completing the attachment of the process cartridge 7.

In the above-described construction, during shipment of the process cartridge, both the developing roller 40 and the charging roller 2 are maintained in the state in which they are spaced apart from the photosensitive drum 1 by the hook 66 and the protrusion 67, so that it is possible to prevent generation of image unevenness due to permanent deformation of the elastic layer and generation of transversal streaks in the image at an interval corresponding to the roller cycle due to rubbing memory during transportation. Then, the hook 66 is automatically released as the process cartridge 7 is inserted into the apparatus main body 100, so that canceling can be reliably effected without causing any bother for the user.

While in this embodiment, described above, the hook 66 and the protrusion 67 are provided only one side surface of the process cartridge 7, it is desirable for them to be provided on both side surfaces of the cartridge 7, which makes it possible to more reliably maintain the separated state during shipment of the process cartridge.

Embodiment 2

In the image forming apparatus main body of Embodiment 1 described above, the cams 80 acting on the process cartridge 7 are of a three-stage construction, thereby making it possible for the developing unit 40 to assume three swinging attitudes. This makes it possible to selectively realize three states with respect to the photosensitive drum 1:

(1) the state in which both the developing roller 40 and the charging roller 2 are in contact with it (first swinging attitude);

(2) the state in which only the developing roller 40 is separated from it (second swinging attitude); and (3) the state in which both the developing roller 40 and the charging roller 2 are separated from it (third swinging attitude).

However, when, for example, the hardness of the elastic rubber layer of the charging roller 2 is low to some degree, the elastic rubber layer does not easily undergo permanent deformation to involve problems regarding image formation even if the process cartridge 7 is left unused for a long period of time inside the image forming apparatus main body 100. In such cases, there is no need to separate the charging roller 2 from the photosensitive drum 1 inside the image forming apparatus main body 100, and it suffices to prevent solely the rubbing memory due to vibration during shipment.

Thus, when the charging roller 2 is used, it is only necessary for the cams 80 to be of a two-stage construction so that the following two states with respect to the photosensitive drum 1 may be realized inside the image forming apparatus main body 100: (1) the state in which both the developing roller 40 and the charging roller 2 are in contact with it (first swinging attitude); and (2) the state in which only the developing roller 40 is in contact with it (second swinging attitude), making it possible to use the cam 80 having two acting portions: a portion 80*a* with minimum radius and a portion 80*b* with medium radius.

In the above-described construction also, the process cartridge 7 is constructed as in Embodiment 1, whereby, during shipment of the process cartridge, the developing roller 40 is enabled to assume the third swinging attitude by the hook 66, that is, by separating the developing roller 40 from the photosensitive drum 1 to a large degree, the action receiving portion 65 receives a force from the acting portion 55 of the developing unit 4 to effect interlocked movement, also enabling the charging roller 2 to be separated from the photosensitive drum 1, thus, making it possible to obtain the same effect as that of Embodiment 1.

Embodiment 3

Figure 14:
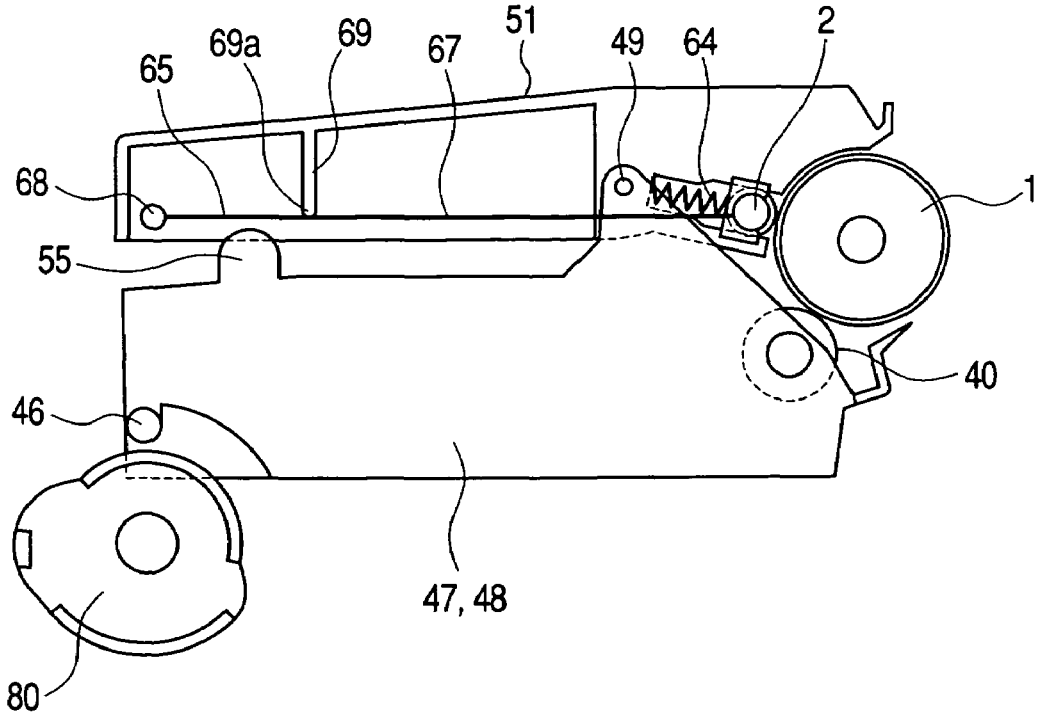
FIG. 14 is a side view of a charging roller separating mechanism of a process cartridge according to another embodiment of the present invention.

While in Embodiment 1 described above, there are provided in the first unit, that is, the photosensitive member unit 50, the links 58 and the cranks 57 as the charging member releasing means, the same effect can be achieved by some other construction. Another embodiment of the charging member releasing means will be described with reference to FIGS. 14 and 15.

First, one end of a wire 67 is connected to either end of the charging roller 2. The other end of each wire 67 is connected to a connecting portion 68 provided at the rear end portion of the cleaning frame 51. The wires 67 are stretched with slight slackening to a degree such that the charging roller 2 is not separated from the photosensitive drum 1 due to variation in dimensional tolerance. Here, inside the cleaning frame 51, there is provided a rib 69 for regulating the wires 67. The distal end 69*a* of the rib 69 extends up to the vicinity of a straight line connecting the center of the charging roller 2 and the connecting portion 68 in the state in which the charging roller 2 is in contact with the photosensitive drum 1.

The portions of the wires 67 between the connecting portion 68 and the distal end 69*a* of the rib constitute the action receiving portions 65; when the action receiving portions 65 are pushed up, the wires 67 pulls the charging roller 2 away from the photosensitive drum 1. On the other hand, the bearing members 47 and 48 of the developing unit 4 has the acting portions 55 in the form of protrusions at positions opposed to the action receiving portions 65.

Figure 15:
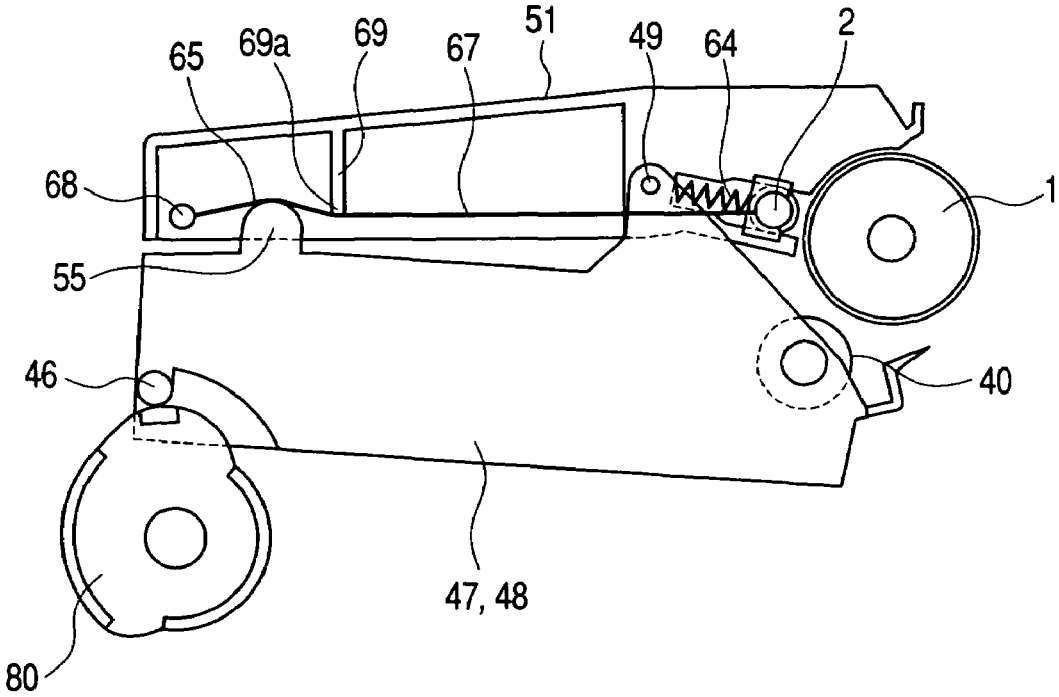
FIG. 15 is a side view of the process cartridge of the embodiment of FIG. 14, showing a state in which the charging roller is separated.

When the force receiving portions 46 receive force from the cams 80 of the apparatus main body 100, solely the developing roller 40 is first separated from the photosensitive drum 1. At the same time, the acting portions 55 move upwards. Then, when the force receiving portions 46 are further pushed up, the acting portions 55 push up the action receiving portions 65, and the contact pressure of the charging roller 2 with respect to the photosensitive drum 1 is reduced, until the charging roller 2 is separated as shown in FIG. 15.

Thus, in the above construction also, as in Embodiment 1, the wires 67 move together with the separating movement of the developing roller 40, enabling the charging roller 2 to be separated from the photosensitive drum 1.

While in the above embodiments the charging roller 2 is provided in the photosensitive member unit 50, this should not be construed restrictively; it is also possible to provide the charging roller 2 in the developing unit 4.

While in this embodiment the photosensitive member unit is stationary and the developing unit is caused to swing, this should not be construed restrictively. For example, it is also possible for the developing unit to be stationary, causing the photosensitive member unit to swing; further, it is also possible to adopt a construction in which both the developing unit and the photosensitive member unit are caused to swing.

In this embodiment, when the first swinging attitude and the second swinging attitude are assumed, the charging roller is at the first position, that is, the charging member is at the position where it is in contact with the photosensitive drum. When the third swinging attitude is assumed, the charging member is at the second position, that is, the charging roller is at the position where it is spaced apart from the photosensitive drum or at a position where the contact pressure of the charging roller with respect to the photosensitive drum is lower than that when it is at the first position. However, the present invention is not restricted to these embodiments. What is necessary is the first, second, and third swinging attitudes can be assumed according to the swinging attitudes of the photosensitive member unit and the developing unit. When the first swinging attitude is assumed, the developing roller comes into contact with the photosensitive drum, and the charging roller comes into contact with the photosensitive drum. When the second swinging attitude is assumed, the developing roller is separated from the photosensitive drum, and the charging roller comes into contact with the photosensitive drum. When the third swinging attitude is assumed, the developing roller is separated from the photosensitive drum, and the charging roller is at a position where it is separated from or in contact with low pressure with the photosensitive drum.

What is claimed is:

1. A process cartridge detachably mountable to an image forming apparatus main body, said process cartridge comprising:

an image bearing member;

a charging member for charging the image bearing member;

a developing member for developing an electrostatic latent image formed on said image bearing member;

a first unit having said image bearing member;

a second unit swingably supported by said first unit and having said developing member; and a charging member releasing means for reducing a contact pressure of said charging member against said image bearing member or separating said charging member from said image bearing member, upon receiving a force from an acting portion, wherein when the acting portion imparts no force to said charging member releasing means, said charging member is in contact with said image bearing member, wherein said first unit and said second unit can relatively assume a first swinging attitude, a second swinging attitude, and a third swinging attitude with respect to each other in accordance with their swinging angles, wherein when said first swinging attitude is assumed, said developing member is held in contact with said image bearing member, and said charging member releasing means receives no force from the acting portion, wherein when the second swinging attitude is assumed, said developing member is separated from said image bearing member, but said charging member releasing means receives no force from the acting portion, and wherein when said third swinging attitude is assumed, said developing member is separated from said image bearing member, and said charging member releasing means receives a force from the acting portion.

2. A process cartridge according to claim 1, wherein said first unit has said charging member and said charging member releasing means, and wherein said second unit has the acting portion.

3. A process cartridge according to claim 1, wherein said charging member releasing means has a link one end of which is connected to said charging member, and a crank rotatably supported by said first unit, and wherein said crank has at least two arms comprising:

a first arm connected to the other end of said link not connected with said charging member; and a second arm receiving a force from the acting portion.

4. A process cartridge according to claim 1, wherein one of said first unit and said second unit has a force receiving portion adapted to receive a force from separating means provided in the image forming apparatus main body for moving said developing member away from said image bearing member, and wherein when said process cartridge is attached to the image forming apparatus main body, said first unit and said second unit can selectively assume said first swinging attitude, said second swinging attitude, and said third swinging attitude by an action of the separating means.

5. A process cartridge according to claim 1, wherein one of said first unit and said second unit has a force receiving portion adapted to receive a force from separating means provided in the image forming apparatus main body for moving said developing member away from said image bearing member, and wherein when said process cartridge is attached to the image forming apparatus main body, said first unit and said second unit can selectively assume said first swinging attitude and said second swinging attitude by an action of the separating means.

6. A process cartridge according to claim 1, further comprising an attitude maintaining member for maintaining said first unit and said second unit in said third swinging attitude when said process cartridge is not attached to the image forming apparatus main body.

7. A process cartridge according to claim 6, wherein the maintaining of said first unit and said second unit in said third swinging attitude by said attitude maintaining member is canceled by an operation of attaching said process cartridge to the image forming apparatus main body.

8. A process cartridge according to claim 6, wherein the maintaining of said first unit and said second unit in said third swinging attitude by said attitude maintaining member is canceled with an operation of attaching said process cartridge to the image forming apparatus main body so as to cause said first unit and said second unit to assume said second swinging attitude.

9. A process cartridge according to claim 4 or 5, wherein the acting portion and said force receiving portion are provided on a bearing member rotatably supporting said developing member.

10. A process cartridge according to claim 1, further comprising a pressurizing member for applying a pressing force between said first unit and said second unit so as to press said developing member against said image bearing member.

11. A process cartridge according to claim 1, wherein said charging member effects charging of said image bearing member while in contact with said image bearing member.

12. A process cartridge detachably mountable to an image forming apparatus main body, said process cartridge comprising:

an image bearing member;

a charging member for charging said image bearing member;

a developing member for developing an electrostatic latent image formed on said image bearing member;

a first unit having said image bearing member;

a second unit swingably supported by said first unit and having said developing member; and charging member moving means for moving said charging member with respect to said image bearing member between a first position and a second position, wherein said first unit and said second unit assume a first swinging attitude, a second swinging attitude, and a third swinging attitude with respect to each other according to their swinging angles, wherein when said first swinging attitude is assumed, said developing member is held in contact with said image bearing member, and said charging member is held in contact with said image bearing member, wherein when said second swinging attitude is assumed, said developing member is separated from said image bearing member, and said charging member is held at said first position by said charging member moving means, and wherein when said third swinging attitude is assumed, said developing member is separated from said image bearing member, and said charging member is held at said second position by said charging member moving means.

13. A process cartridge according to claim 12, wherein when said charging member is at said first position, said charging member is situated at a position at which said charging member is in contact with said image bearing member, and wherein when said charging member is at said second position, said charging member is situated at one of a position at which said charging member is separated from said image bearing member and a position at which said charging member is in contact with said image bearing member with a contact pressure lower than that between said charging member and said image bearing member when said charging member is at said first position.

14. A process cartridge according to claim 12 or 13, wherein said first unit has said charging member and said charging member moving means, and wherein said second unit has an acting portion for acting on said charging member moving means to move said charging member between said first position and said second position.

15. An image forming apparatus for forming an image on a recording medium, comprising:

a process cartridge detachably mountable to an image forming apparatus main body, said process cartridge comprising:

a first unit having an image bearing member;

a second unit swingably supported by said first unit and having said developing member; and charging member releasing means for reducing a contact pressure of said charging member against said image bearing member or separating said charging member from said image bearing member, upon receiving a force from an acting portion, wherein when the acting portion imparts no force to said charging member releasing means, said charging member is in contact with said image bearing member, wherein said first unit and said second unit assume a first swinging attitude, a second swinging attitude, and a third swinging attitude with respect to each other in accordance with their swinging angles, wherein when said first swinging attitude is assumed, said developing member is held in contact with said image bearing member, and said charging member releasing means receives no force from the acting portion, wherein when said second swinging attitude is assumed, said developing member is separated from said image bearing member, but said charging member releasing means receives no force from the acting portion, and wherein when said third swinging attitude is assumed, said developing member is separated from said image bearing member, and said charging member releasing means receives a force from the acting portion; and separating means that is brought into contact with said process cartridge, for causing said first unit and said second unit to selectively assume said first swinging attitude, said second swinging attitude, and said third swinging attitude.

16. An image forming apparatus according to claim 15, wherein said process has an attitude maintaining member for maintaining said first unit and said second unit in said third swinging attitude when said process cartridge is not attached to the image forming apparatus main body, and wherein said image forming apparatus further comprises an abutting portion which, when said process cartridge is attached to said image forming apparatus main body, acts on said attitude maintaining member to cancel the maintaining of said first unit and said second unit in said third swinging attitude.

17. An image forming apparatus according to claim 15, wherein, when said first unit and said second unit assume said second swinging attitude, said charging member starts charging said image bearing member, and wherein the attitude of said first unit and said second unit is changed from said second swinging attitude to said first swinging attitude by said separating means so that said developing member comes into contact with a region on said image bearing member charged by said charging member.

* * * * *

UNITED STATES PATENT AND TRADEMARK OFFICE

CERTIFICATE OF CORRECTION

PATENT NO. : 6,980,759 B2
APPLICATION NO. : 10/835116
DATED : December 27, 2005
INVENTOR(S) : Kanno et al.

It is certified that error appears in the above-identified patent and that said Letters Patent is hereby corrected as shown below:

ON THE TITLE PAGE
Item (56), Foreign Patent Documents, "JP 2001-337511 12/2001" should be deleted.
Item (56), Foreign Patent Documents, "JP 2002-6722 1/2002" should be deleted.

COLUMN 10
Line 43, "no" should read --not--.

COLUMN 12
Line 60, "cartridge is" should read --cartridge--.

Signed and Sealed this

Fifteenth Day of August, 2006

JON W. DUDAS
*Director of the United States Patent and Trademark Office*